US005174785A

United States Patent [19]

Endo et al.

[11] Patent Number: 5,174,785

[45] Date of Patent: Dec. 29, 1992

[54] LOW INSERTION-WITHDRAWAL FORCE ELECTRIC CONNECTOR

[75] Inventors: Takayoshi Endo; Takashi Ishii; Hitoshi Sakai; Shigemi Hashizawa; Toshihiko Masuda, all of Shizuoka, Japan

[73] Assignee: Yazaki Corporation, Tokyo, Japan

[21] Appl. No.: 728,504

[22] Filed: Jul. 11, 1991

[30] Foreign Application Priority Data

Jul. 17, 1990 [JP] Japan ..... 2-187275
Jul. 27, 1990 [JP] Japan ..... 2-197739

[51] Int. Cl.[5] ..... H01R 3/00
[52] U.S. Cl. ..... 439/489; 439/157; 439/372
[58] Field of Search ..... 439/372, 152–160; 361/399, 415

[56] References Cited

U.S. PATENT DOCUMENTS

| | | | |
|---|---|---|---|
| 2,939,103 | 5/1960 | Agron et al. | 439/157 |
| 2,987,693 | 6/1961 | Wamsley | 439/157 |
| 3,784,954 | 1/1974 | Grimm et al. | 439/160 |
| 4,582,378 | 4/1986 | Fruchard | 439/157 |
| 4,914,550 | 4/1990 | Filsinger et al. | 439/372 |

FOREIGN PATENT DOCUMENTS

| | | | |
|---|---|---|---|
| 0974126 | 2/1951 | France | 439/372 |
| 0999861 | 2/1952 | France | 439/372 |
| 60-51892 | 4/1985 | Japan . | |
| 60-254576 | 12/1985 | Japan . | |
| 62-178469 | 11/1987 | Japan . | |
| 63-2375 | 1/1988 | Japan . | |
| 63-99787 | 6/1988 | Japan . | |
| 63-99788 | 6/1988 | Japan . | |
| 1-241778 | 9/1989 | Japan . | |
| 0135937 | 7/1960 | U.S.S.R. | 439/372 |

*Primary Examiner*—David L. Pirlot
*Attorney, Agent, or Firm*—Sughrue, Mion, Zinn, Macpeak & Seas

[57] ABSTRACT

A low insertion-withdrawal force electric connector is disclosed wherein a pin is mounted on one side wall of a male housing; a groove into and out of which said pin is movable is provided in a hood of a female housing; a cam lever is pivotally mounted on said hood; and the cam lever has at its front end an eccentric cam groove which is engageable with the pin so as to cause said two housings to be fitted and disengaged relative to each other in response to the pivotal movement of said lever. A fitting-side acting surface of the eccentric cam groove against the pin is disposed generally perpendicular to the direction of advance of said pin when the two housings are completely fitted together.

9 Claims, 9 Drawing Sheets

LOW INSERTION-WITHDRAWAL FORCE ELECTRIC CONNECTOR

BACKGROUND OF THE INVENTION

This invention relates to a low insertion-withdrawal force electric connector used for connecting wire harnesses together or for connecting a wire harness to an electric device. It also relates to a low insertion-withdrawal force electric connector used, for example, for connecting many electric wires.

A conventional electric connector, in which by fitting female and male connectors relative to each other, a pair of terminals contained therein are electrically connected together, has a locking device for maintaining a connected condition which includes a lock arm and an engaging projection. A sensory indication of a locked condition at the time of engagement of the lock arm with the engaging projection, as well as visual confirmation of the fitting is obtained.

However, the touch indication for the operation varies depending on the speed of fitting of the connectors, the atmosphere of the use, differences between individuals, and so on. The visual inspection may also involve an erroneous judgment or an overlook, and thus both may fail to provide positive confirmation means.

Therefore, as shown in FIGS. 1A and 1B, Japanese Laid-Open (Kokai) Patent Application No. 241778/89 discloses a construction in which a lock plate b movable between a locked position and an unlocked position, as well as a holder portion c for holding the lock plate b in the locked position, is provided on a female connector a, and a male connector d is provided with a lock portion e for locking the lock plate b upon completion of the locking thereof relative to the female connector a. At the time of the locking, a short-circuit piece f mounted on the lock plate b is abutted against a short-circuit terminal g to turn on an alarm lamp, thereby enabling the fitting to be electrically confirmed.

In the electric connector as shown in FIGS. 1A and 1B, the operation for fitting the female and male connectors a and d is independent of the operation for locking the lock plate b, and therefore there is a risk that the operator may finish the operation, forgetting to lock the lock plate b. And besides, because of a multi-pole (increased number of connector terminals) design of the connector, a large fitting force is required for the fitting between female and male terminals, and therefore there are occasions when the operation can not be carried out easily.

On the other hand, when the number of poles (i.e., the number of connector terminals) is increased, a greater force is required for fitting and disengaging female and male connectors relative to each other because of increased frictional resistances between terminals, and therefore the operation can not be carried out easily.

In view of the above, in order to reduce the insertion and withdrawal force, Japanese Laid-Open (Kokai) Patent Application No. 157076/89 discloses a construction in which a slide cam is mounted on a hood of a concave housing in perpendicularly intersecting relation to axes of terminals, and a cam track with which a cam follower for the slide cam is engaged is provided on a convex housing.

In the electric connector of this type, as shown in FIG. 2, as compared with the force (indicated by a curve fo) required only for the fitting of female and male terminals, the fitting can be done with a smaller force (indicated by a curve f1) thanks to the provision of the slide cam; however, when the convex housing is fitted a certain depth d, the insertion force becomes substantially constant (k1), and therefore the operator does not perceive any sensory indication of the completion of the fitting operation, and hence may stop the operation before completion which leads to a risk that an incomplete fitting may be encountered.

SUMMARY OF THE INVENTION

The present invention has been made in view of the above problems, and an object of the invention is to provide a construction in which the fitting between female and male connectors and a locking operation thereof, can be done at the same time with a small force even in the case of a multi-pole design, and also a complete fitting between the connectors and the locking thereof is electrically confirmed without resort to a sense of operating touch or a visual inspection.

To achieve the above object, according to the present invention, there is provided a low insertion-withdrawal force electric connector having a pair of mating connectors for being fitted together, wherein pins are formed respectively on opposite sides of one of the connectors. Grooves are formed respectively in opposite sides of the other connector for accepting the pins, and cam levers are rotatably mounted respectively on the opposite sides of the other connector. Each of the cam levers has, at its front end, an eccentric cam groove which is engageable with a respective pin so as to perform the fitting and disengagement of said two connectors relative to each other in response to the angular movement of the cam lever. An operating plate interconnects the two cam levers and a resilient member is provided on the other connector to urge the operating plate upward so as to hold the cam levers in an upstanding condition. A disengagement-side groove wall of each of the eccentric cam grooves provides a wide surface for engagement with a respective pin when the cam levers are in their upstanding position.

Preferably, there is provided a lock portion which is lockable relative to the operating plate when the mating of the connectors is completed.

The operating plate of the other connector can have a short-circuit piece which is contacted with short-circuit terminals of an electric circuit, serving as fitting confirmation means, in the locked condition of the operating plate to thereby complete the circuit. The short-circuit terminals being contained in the other connector. With this arrangement, complete mating and a locked condition can be electrically confirmed.

In the present invention, thanks to the provision of the pins and the leverage of the cam levers having the eccentric cam grooves engageable respectively with the pins, the pair of connectors can be fitted together and disengaged from each other with a small force even if they are multi-pole connectors.

When one of the connectors is inserted into the other, each pin impinges upon the wide surface (the disengagementside groove wall), so that the lever is slightly tilted toward the front side. In this condition, when the levers are pulled down sufficiently, the two connectors are completely fitted together. At the same time, the operating plate is locked, and the short-circuit piece is contacted with the short- circuit terminals, so that for example, a lamp of a check circuit is turned on, thereby enabling an electrical confirmation of the complete fitting and the locking.

Thus, since the fitting operation and the locking, as well as the confirmation thereof, are carried out simultaneously, in contrast with the prior art, the fitting operation will not be abandoned halfway, and the incomplete mating will not be overlooked, Before the fitting of the connectors, the operating plate is held in an upstanding condition by the resilient member, and this plate is tilted toward the front side at the initial stage of the fitting between the two connectors, and therefore the cam levers (the operating plate) can be easily pulled down. Therefore, the other connector can be fitted in the electric device or a panel, and can be used in this condition.

Another object of the invention is to provide a low insertion-withdrawal force electric connector in which a suitable indicative sensory perception can be obtained by making use of inertia when fitting female and male connector housings relative to each other, so that a good operability is obtained, and an incomplete fitting is prevented.

The above object has been achieved by a low insertion-withdrawal force electric connector wherein a pin is mounted on one side wall of a male housing and a groove into which said pin is insertable is provided in a hood of a female housing. A cam lever is pivotally mounted on the hood; and has at its front end an eccentric cam groove which is engageable with the pin so as to cause the housings to be fitted and disengaged relative to each other in response to pivotal movement of the lever. A a fitting-side acting surface of the cam groove is disposed generally perpendicular to the direction of advance of said pin when the two housings are completely fitted together.

According to the present invention, the angle of contact between one groove wall surface (acting surface) of the eccentric cam groove of the cam lever and the pin decreases with the increase of the degree of fitting between the female and male housings, so that the direction of the force acting on the pin coincides with the direction of advance of the pin. Therefore, when a certain fitting depth is achieved, the insertion force becomes the maximum.

Therefore, the fitting between the female and male connector housings is performed making use of the inertia, and a proper indicative sensory perception is obtained, so that good operability is obtained, and an incomplete fitting is eliminated.

DESCRIPTION OF THE PREFERRED EMBODIMENT

Figure 1A:
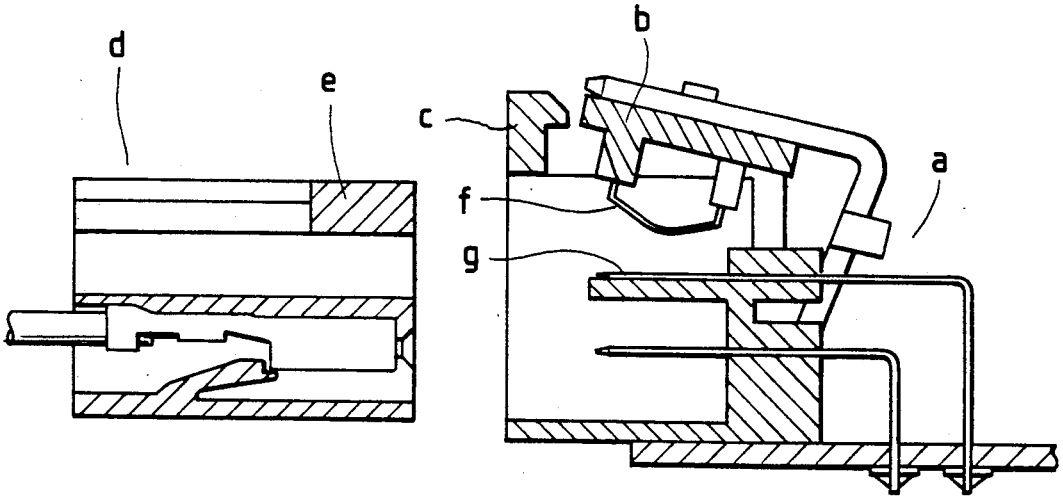
FIG. 1A PRIOR ART
FIGS. 1A and 1B are cross-sections showing a separated condition and a fitted condition of a conventional electric connector, respectively.
Figure 1B:
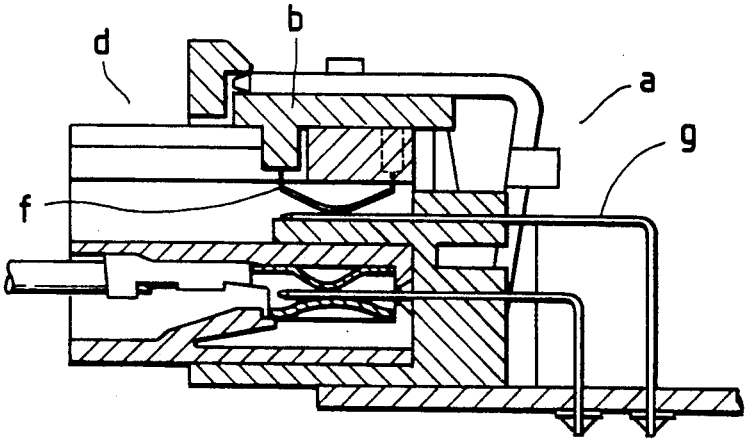
FIG. 1B PRIOR ART
Figure 2:
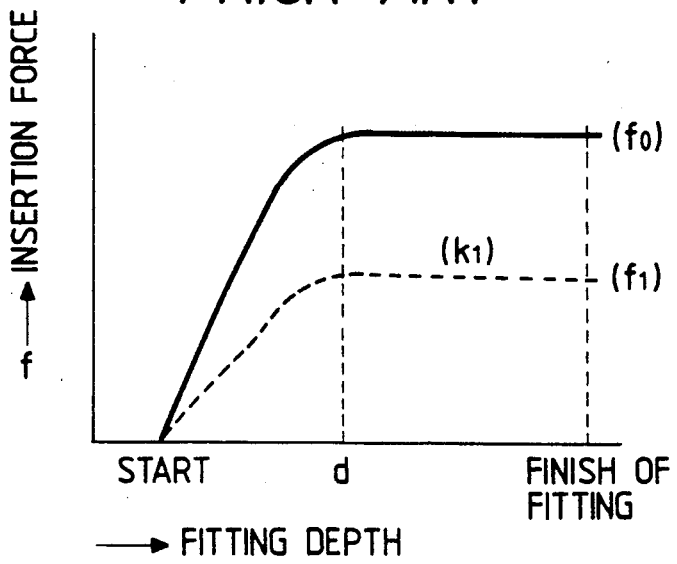
FIG. 2 PRIOR ART
FIG. 2 is a graph showing the relation between a fitting depth of a conventional connector and an insertion force.

The above construction and operation will now be described specifically with reference to the drawings showing an embodiment.

In FIGS. 3 to 8, reference characters A and B denote a female connector and a male connector, respectively. The female connector A contains pin-like male terminals C and U-shaped short-circuit terminals C', and the male terminal B contains female terminals D. The female connector A is attached to an electronic unit E to be mounted on a vehicle, and the proximal ends of the pin-like terminals C are soldered to a circuit 2 of a printed circuit board 1.

The male connector B is a multi-pole connector having many terminal receiving chambers 3 arranged in upper and lower rows. Its insulative housing 4 is divided by slits 5 into three sections B1, B2 and B3, and the female terminal D is received in each receiving chamber 3, and is retained there by a known means.

Figure 3:
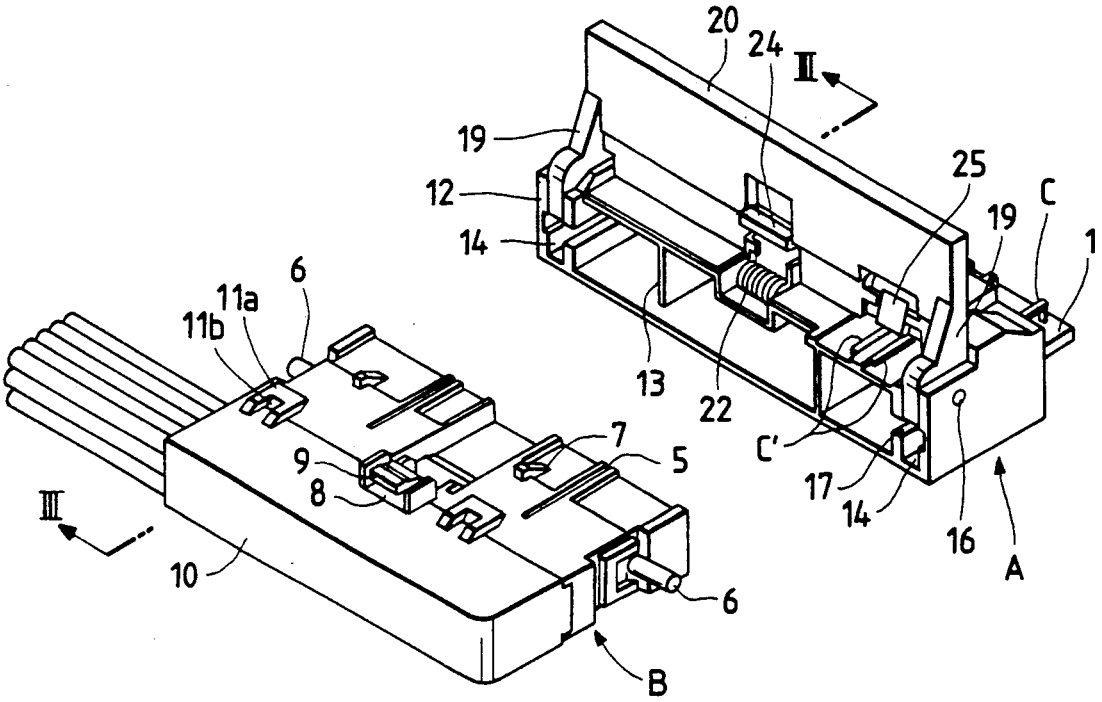
FIG. 3 is a perspective view of one preferred embodiment of an electric connector of the present invention in a separated condition.

Pins 6 are projectingly formed respectively on the opposite sides of the housing 4 of the male connector B, and provisional retaining projections 7 are formed on its upper surface at opposite side portions thereof, and a flexible lock arm 8 is provided on the central portion of the upper surface. As shown in FIG. 3, the flexible lock arm 8 has a lock portion 9 having a tapered engaging surface 9*a*. A cover 10 is attached to the electric wire lead-out side of the male connector B, and is locked thereto by lock means 11*a* and 11*b*.

The female connector A has at its front side a hood 12 for receiving the male connector B, and the hood 12 is divided by partition walls 13 into three chambers $\mathbf{12}_1$, $\mathbf{12}_2$ and $\mathbf{12}_3$ in corresponding relation to the male connector B. As shown in FIG. 3, the U-shaped short-circuit terminals C' are provided to be extended from an outer wall 12*a* of the chamber $\mathbf{12}_3$ into the interior of this chamber.

A lever member F is pivotally mounted on the hood 12, and comprises a pair of cam levers 19 for fitting and disengagement relative to the male connector B, and an operating plate 20 interconnecting the two levers 19.

Figure 5:
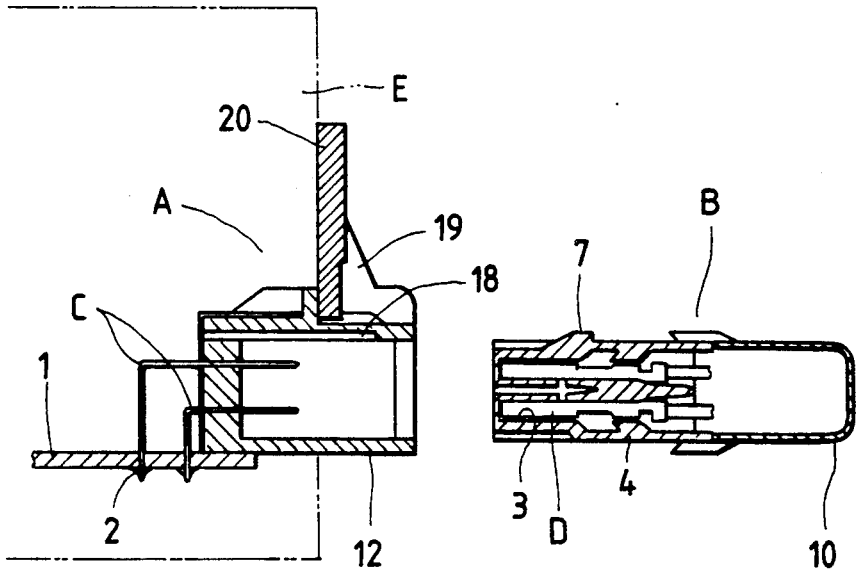
FIG. 5 is a cross-sectional view taken along the line III—III of FIG. 3.
Figure 4:
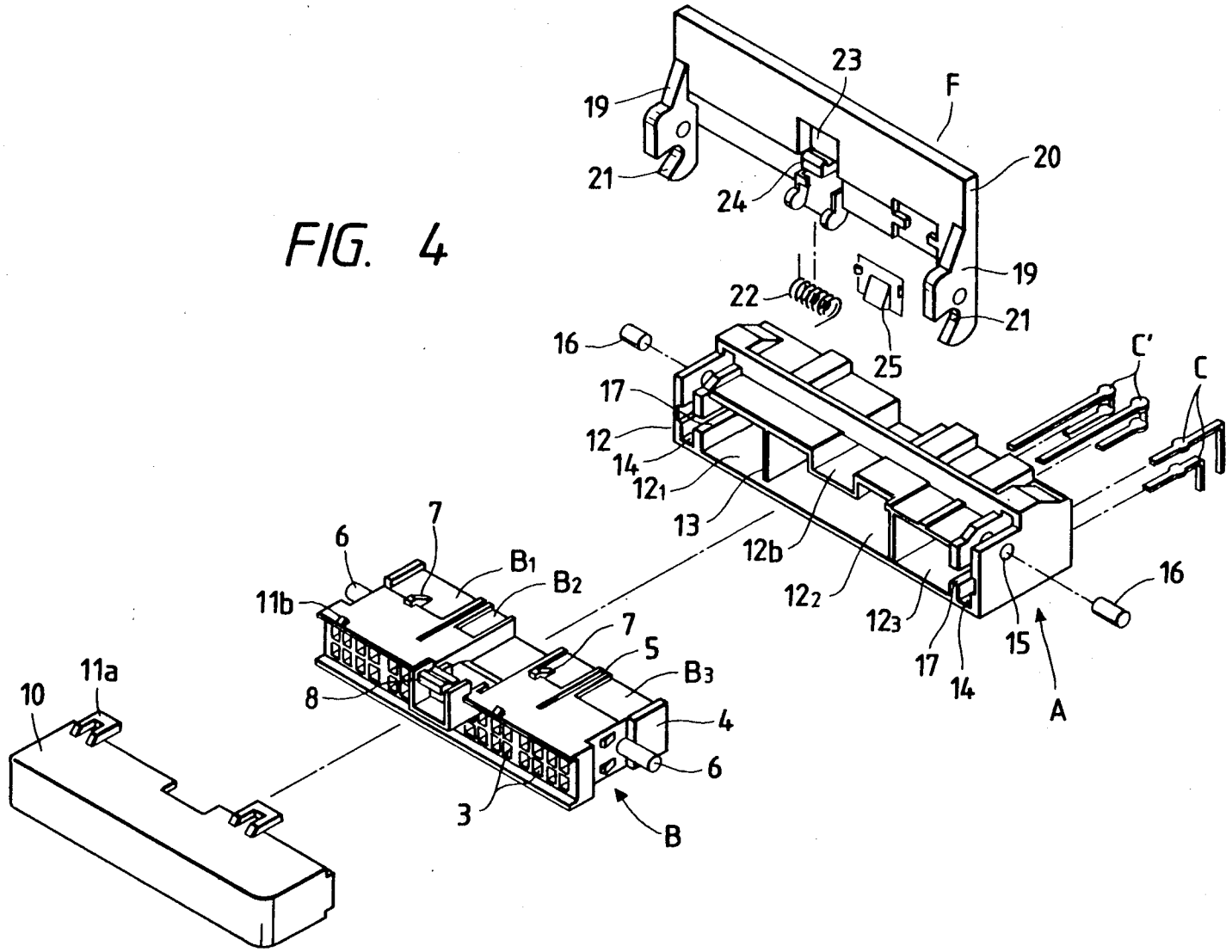
FIG. 4 is an exploded, perspective view of the above connector.

Namely, the hood 12 has at its opposite (right and left) sides lever-mounting chambers 14 each having double (inner and outer) walls, and each cam lever 19 is pivotally mounted on a pin-like shaft 16 fixedly mounted in a shaft hole 15 in the chamber 14. A groove 17 is formed in the inner wall of each of the mounting chambers 14, and the pin 6 of the male connector B is moved into and out of the groove 17 (see FIG. 6). As shown in FIG. 5, the hood 12 has retaining grooves 18 for the provisional retaining projections 7 of the male connector B.

Each cam lever 19 has at its front end an eccentric cam groove 21 for engagement with the pin 6 of the male connector B, and a coil spring (resilient member) 22 is interposed between the operating plate 20 and a central recess 12*b* in the upper wall of the hood 12, so that the operating plate 20 and the cam levers 19 are urged upward to be upstanding relative to the upper surface of the hood 12 in a normal condition.

A window 23 is formed through the central portion of the operating plate 20, and the flexible lock arm 8 of the male connector B is movable into and out of this window 23. A lock projection 24 having a tapered engaging portion 24*a* is formed integrally with the edge of this window, and a short-circuit piece 25 is fixedly secured to the lower surface of the plate 20 in opposed relation to the short-circuit terminals C'.

Figure 6A:
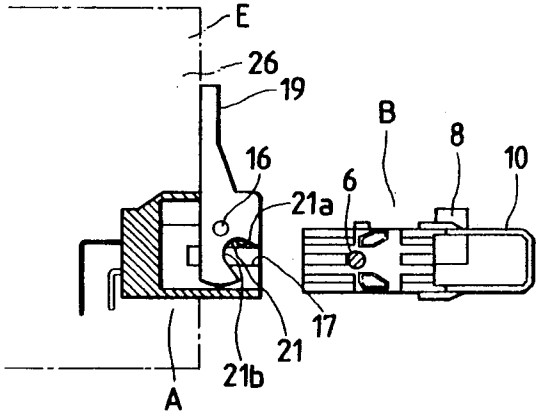
FIGS. 6A to 6E are views explanatory of the operation of a cam lever.

As shown in FIG. 6A, the eccentric cam groove 21 of the cam lever 19 has a sufficient play G for the pin 6 of the male connector B, and in the upstanding condition of the lever 19, one groove wall (hereinafter referred to as "fitting-side groove wall") 21*a* is generally parallel to the groove 17, and is disposed above this groove 17 whereas the other groove wall (hereinafter referred to as "disengagement-side groove wall") 21*b* extends obliquely across the groove 17 so as to provide a wide surface for the pin 6.

Next, the fitting and disengagement of the female and male connectors A and B will now be described.

In FIG. 6A, the cam levers 19 of the female connector A attached to the electronic unit E are urged upward by the coil spring 22 into the upstanding condition, so that the cam levers are supported by and held in contact with a front surface 26 of this unit.

Figure 6B:
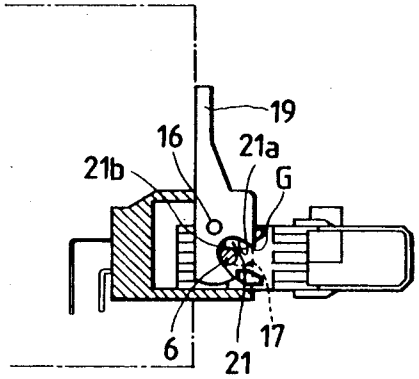

In this condition, when the male connector B is inserted into the hood 12, each pin 6 introduced into the groove 17 impinges upon the disengagement-side groove wall 21*b* of the eccentric cam groove 21 (FIG. 6B). When the male connector is further inserted, each cam lever 19 is angularly moved about the pin-like shaft 16 in a direction of arrow P as shown in FIG. 6C, so that the cam lever is tilted toward the front side, and as a result a gap H is formed between the cam lever and the front surface 26.

Figure 6C:
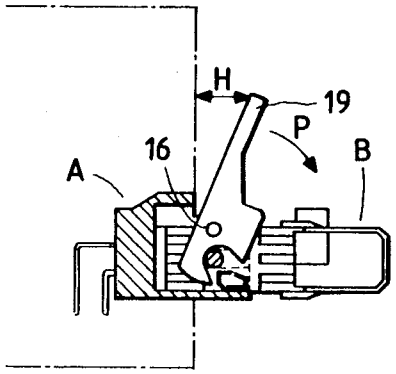

In the condition shown in FIG. 6C, the provisional retaining projections 7 of the male connector B shown in FIG. 5 are engaged respectively in the retaining grooves 18 of the female connector A, so that the two connectors A and B are in a provisionally retained condition. At the same time, the pin-like male terminals C begin to be contacted with the female terminals D, respectively.

Figure 6D:
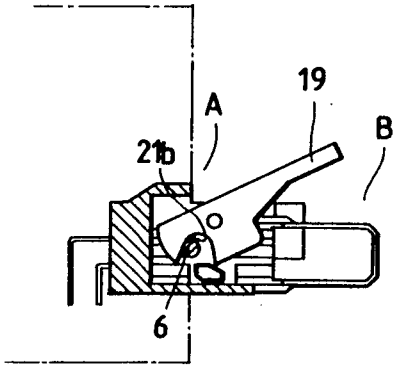
Figure 6E:
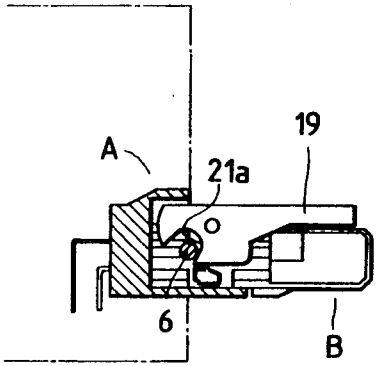

When the cam levers 19 are further pivotally moved in the direction of arrow P, the fitting-side groove wall 21*a* of each eccentric cam groove 21 is engaged with the pin 6 to urge and propel the same, as shown in FIGS. 6D and 6E, and therefore the fitting between the female and male connectors A and B is completed. Thanks to the leverage of the cam levers 19, the fitting between the two connectors A and B can be carried out with a small force.

FIGS. 7A and 7B and FIGS. 8A and 8B respectively show the locking process of the operating plate 20 and the short-circuiting process of the short-circuit piece 25 which correspond to the conditions shown in FIGS. 6D and 6E.

In the process from the half fitted condition (FIG. 7A) of the female and male connectors A and B to the completely fitted condition (FIG. 7B), the tapered engaging portion 24*a* of the lock projection 24 of the operating plate 20 slidingly contacts the tapered engaging portion 9*a* of the lock portion 9 of the lock arm 8 to urge the lock portion 9 downward, and slides past the lock portion 9 to reach a position beneath this lock portion simultaneously with complete fitting, so that the two connectors are completely locked together.

Therefore, if the above angular movement of the cam levers 19 (the operating plate 20) is stopped before completion, the levers 19 are returned to the initial fitting condition (FIG. 6C) by the resilient force of the coil spring 22, or are held in a half fitted, open condition.

Figure 8A:
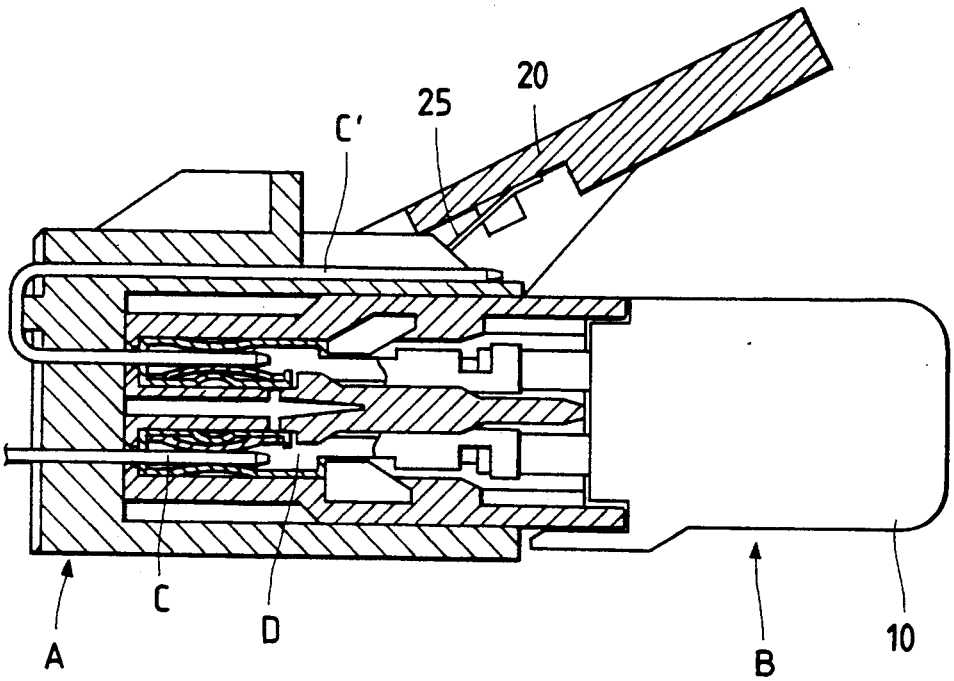
FIGS. 8A and 8B are cross-sectional views showing the process of contacting between a short-circuit piece 25 and short-circuit terminals C'.
Figure 8B:
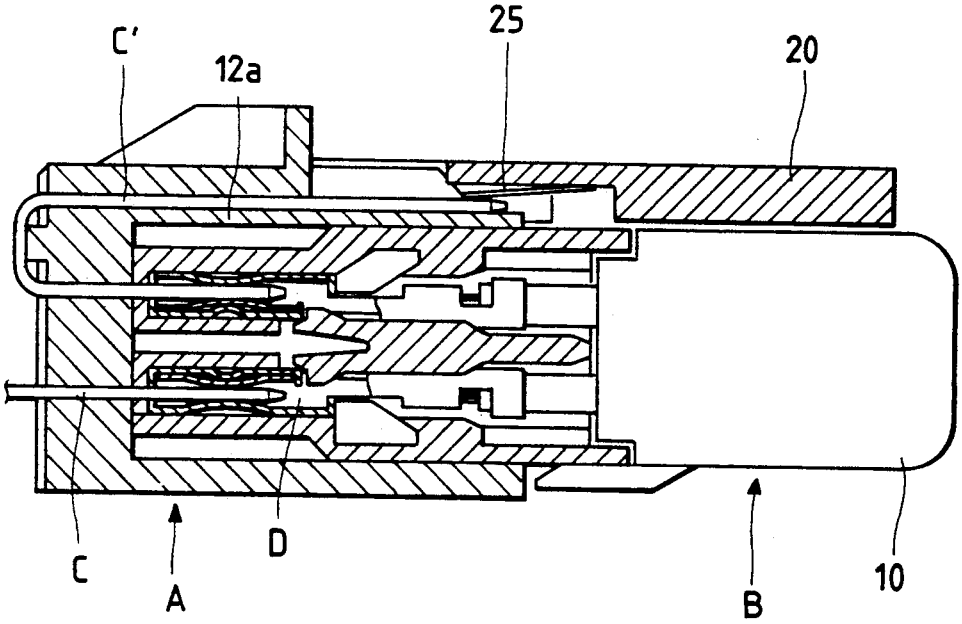

Similarly, as shown in FIG. 8B, the short-circuit piece 25 is contacted with the short-circuit terminals C' when the two connectors A and B are in the completely fitted and locked condition, and as a result an electric circuit (not shown) serving as means for confirming the complete fitting of the connectors is closed, and therefore for example, an alarm lamp is turned on, so that this condition can be confirmed. In the half fitting condition shown in FIG. 8A, the short-circuit piece 25 is not in contact with the terminals C', or this contact is released, and therefore the incomplete fitting can be detected.

Figure 7A:
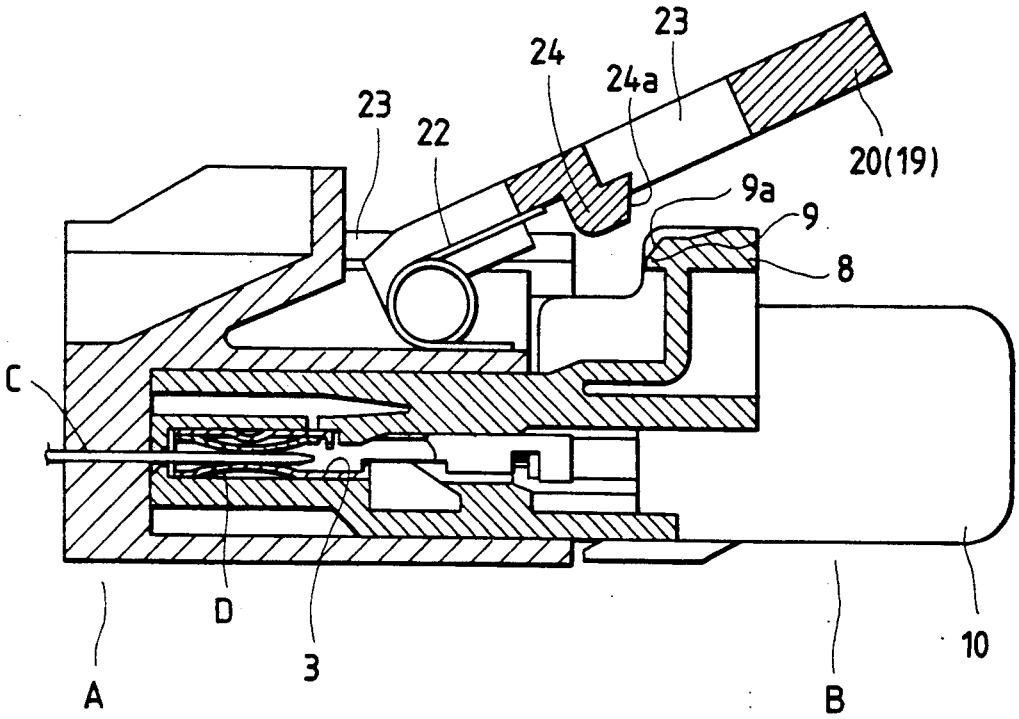
FIGS. 7A and 7B are cross-sectional views showing a locking operation between an operating plate 20 and a male connector B.
Figure 7B:
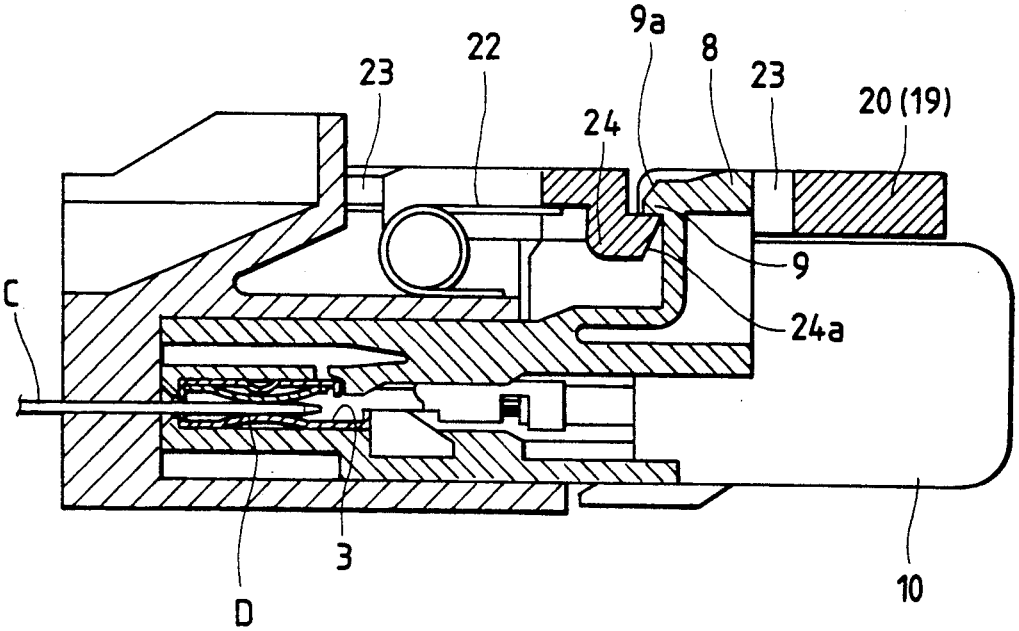

When the female and male connectors A and B are to be disengaged from each other, in FIG. 7B, the lock arm 8 is pulled down by the tip of the finger toward the font side to release the engagement between the lock portion 9 and the lock projection 24, and then the cam levers 9 are turned in a direction opposite to the direction of arrow P shown in FIG. 6.

In the above example, although the female connector A is incorporated in the electronic unit E, it can, of course, be an independent connector. Also, instead of the pin-like male terminals C, ordinary male terminals for press-connecting electric wires can be used.

As described above, according to the electric connector of the present invention, even if the pair of connectors are multi-pole connectors, they can be fitted together and disengaged from each other with a small force due to the leverage of the cam levers, and therefore the operability is enhanced.

Also, the fitting operation and the locking operation of the pair of connectors are carried out at the same time, and the complete fitting and the locked condition can be electrically confirmed. Therefore, the partial fitting is prevented, and the reliability in the electrical connection can be enhanced.

Another embodiment will be described with reference to FIGS. 9 to 13.

Figure 9:
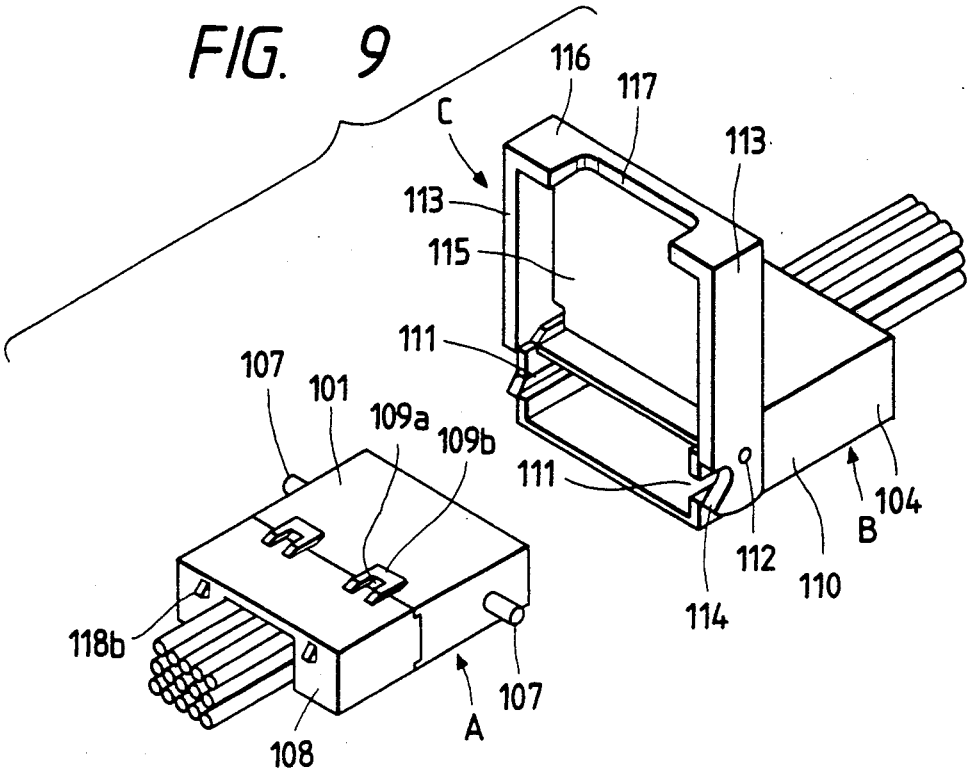
FIG. 9 is a perspective view of female and male connectors of the present invention separated from each other.
Figure 10:
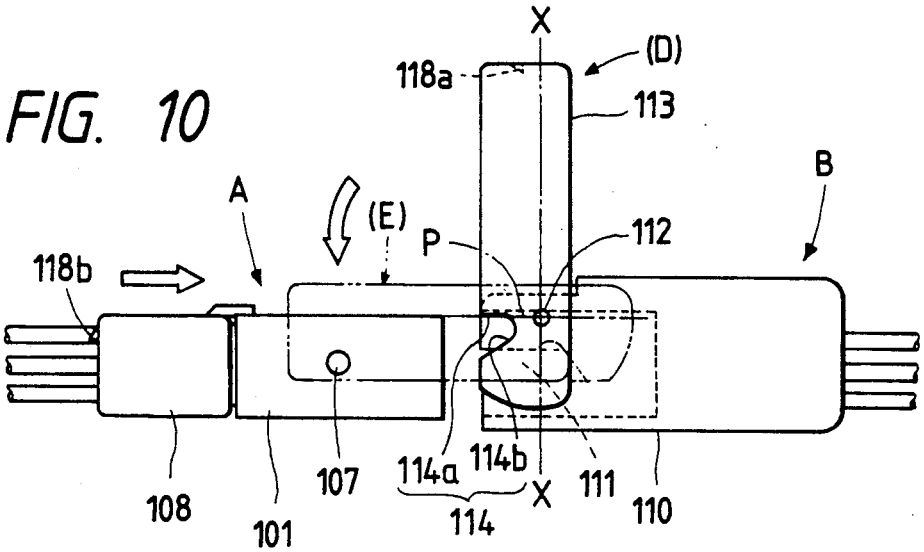
FIG. 10 is a side-elevational view thereof.
Figure 11:
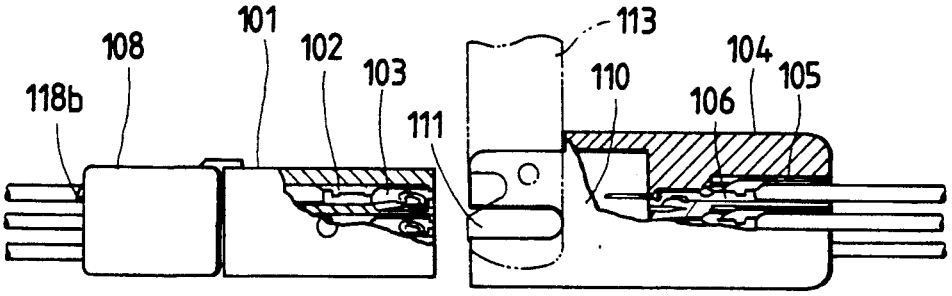
FIG. 11 is a partly-broken, side-elevational view similar to FIG. 10.

FIG. 9 is a perspective view showing female and male connectors which are separated from each other, FIG. 10 is a side-elevational view thereof, and FIG. 11 is a partial sectional view thereof.

In these Figures, reference character A denotes the male connector, and reference character B denotes the female connector. A male housing 101 of the male connector A has terminal receiving chambers 102 arranged in a multi-stage manner, and female terminals 103 are received and retained respectively in these terminal receiving chambers. Similarly, male terminals 106 are inserted respectively in terminal receiving chambers 105 of a female housing 104 of the female connector B. The construction and retaining mechanisms of both terminals 103 and 106 can be of a conventional type, and therefore explanation thereof is omitted here.

Pins 107 are respectively formed on and projected from the opposite side walls of the male housing 101 of the male connector A, and a cover 108 is attached to the wire-connecting rear side of this housing, and is locked thereto by lock members 109*a* and 109*b*.

The female housing 104 of the female connector B has at its front side a hood 110 for receiving the male connector A. Grooves 111 into which the pins 107 can be removably received, respectively, are formed respectively in the opposite side walls of the hood 110, and cam levers 113 are pivotally connected respectively to these opposite side walls through fixed pins 112. Although the male connector A is guided by the hood 110 so as to be fitted in the female connector B, the grooves 111 may be used as guide grooves for the pins 107.

The cam lever 113 has at one end an eccentric cam groove 114 in which the pin 107 is engageable. The eccentric cam groove 114 is of a generally inverted V-shape, has a wide inlet, and in width progressively toward its bottom. The eccentric cam groove has groove wall surfaces 114*a* and 114*b* disposed in intersecting relation to each other. Preferably, one groove wall surface 114*a*, serving as an acting surface for the fitting operation, is provided perpendicular to a horizontal axis x of the cam lever 113. More preferably, alignment is made in such a manner that when the cam levers 113 are laid down from an upstanding position D (FIG. 10) to a horizontal position E (hereinafter referred to as "closed position") indicated by two dots-and-dash line, the fitting between the female and male connectors B and A is completed, and also each groove wall surface 114*a* coincides with a vertical line P extending perpendicularly from the fixed shaft 112 to the horizontal plane x, and also the groove wall surface 114*a* is held in contact with the pin 107.

In this embodiment, the cam levers 113 at the opposite sides of the hood 110, a lid plate 115 interconnecting the two levers, and a back plate 116 jointly constitute a lock cover C for the male connector A. The back plate 116 has a notch 117 for the passage of electric wires therethrough, and lock members 118*a* and 118*b* act between the cover C and the cover 108.

Next, the operation of the cam lever 113 will be described (FIGS. 12A to 12D).

Figure 12A:
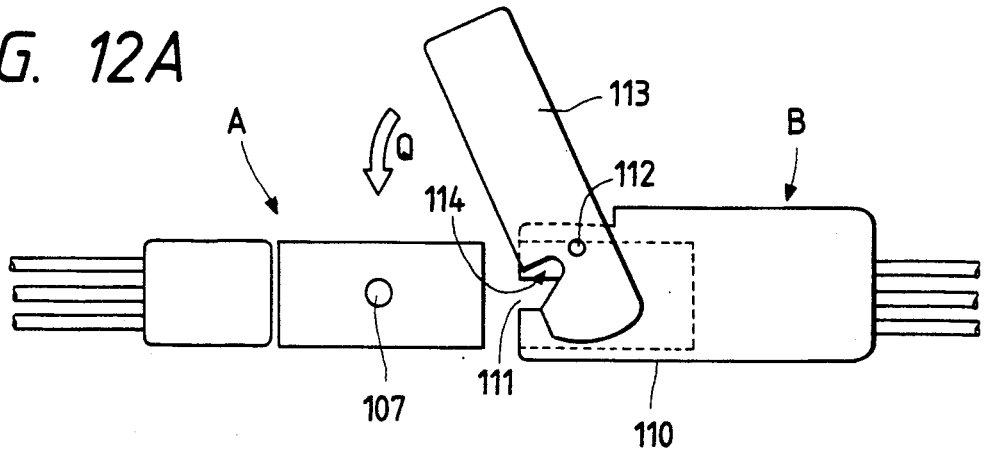
FIGS. 12A to 12D are views explanatory of the operation of a cam lever.

FIGS. 12A shows the female and male connectors B and A as being separated from each other.

Figure 12B:
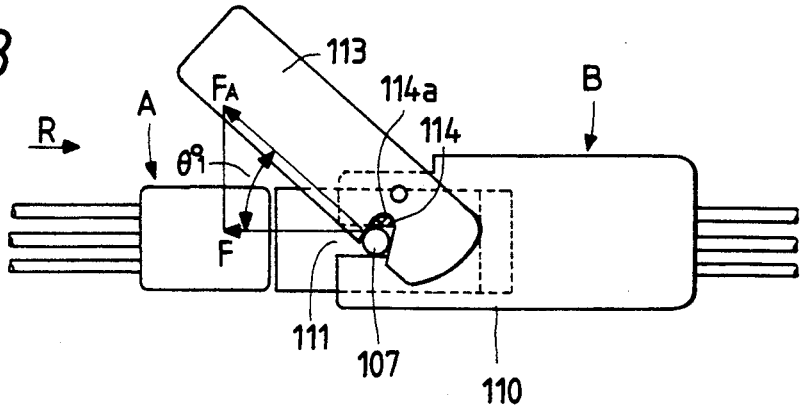

FIG. 12B shows an initial stage of the fitting operation in which the male connector A is inserted into the hood 110 with the pins 107 disposed respectively in registry with the grooves 111, and the cam levers 113 are turned in a direction of arrow Q, so that the eccentric cam grooves 114 are engaged respectively with the pins 107.

In this initial engaging condition, each pin 107 is engaged with the inlet end of the groove wall surface 114. At this time, the angle of intersection (the above-mentioned contact angle) between the direction R of advance of the pin 107 and the horizontal axis x of the cam lever 113 is represented by $\theta 1$.

If the force exerted by the cam lever 113 on the pin 107 is represented by FA, its horizontal component force F (propelling force for the pin 107) is expressed by $F = FA \cos \theta 1$.

Namely, the acting force FA for the male connector A and the propelling force F are different in direction and magnitude, and the loss of the force is expressed in the following:

$$FA - F = (F/\cos \theta 1) - F = F(1 - \cos\theta 1)/\cos \theta 1$$

Figure 12C:
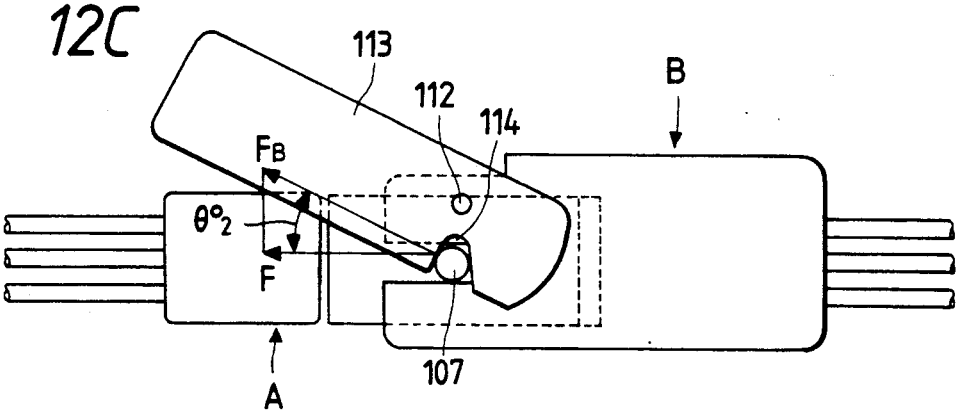

FIG. 12C shows an intermediate stage in which the fitting has further proceeded through angular movement of the cam levers 113. At this time, as in FIG. 12B, if the angle of intersection between the horizontal axis x of the cam lever 113 and the direction of advance of the pin 107 is represented by 82, $F = FB \cos \theta 2$ is obtained, and therefore the loss of the force is expressed in the following:

$$F(1 - \cos \mu 2)/\cos \theta 2$$

Figure 12D:
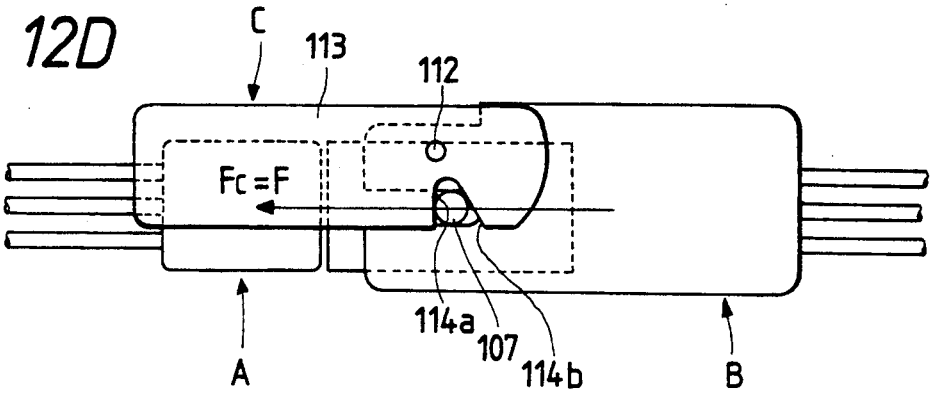

Then, in a complete fitting condition shown in FIG. 12D, $\theta = 0°$ is established, and therefore $Fc = F$ is obtained, and the loss of the force is zero, and the following is obtained:

$$FA > FB > FC$$

In the complete fitting condition shown in FIG. 12D, the cam lever 113 is in its closed position, and therefore the lock cover C is locked relative to the cover 108 of the male connector A by the lock members 118*a* and 118*b*.

For releasing the fitting between the female and male connectors B and A, the cam levers 113 are angularly moved according to a procedure reserve to that shown in FIGS. 12A to 12D. In this case, the other groove wall surface 114*b* of the eccentric cam groove 114 is engaged with the pin 107.

As described above, in the present invention, the acting point of the cam lever 113 against the pin 107, as well as the acting force (FA, FB . . . ), varies with the depth of fitting of the male connector A, and the smaller the contact angle ($\theta 1$, $\theta 2$ . . . ), the smaller the loss of the force. When the direction of fitting of the male connector A (the direction of advance of the pin 107) is the same as the direction (FC) of the cam lever as shown in FIG. 12D, the force applied to the lever can be minimized.

As described above with reference to FIG. 10, in the condition of complete fitting between the female and male connectors B and A, preferably, the cam lever 113 is in its closed position, and also preferably, the fitting-side groove wall surface 114*a* of the eccentric cam groove 114 is disposed perpendicular to the direction R of fitting of the male connector A.

As will be appreciated from the principle of leverage, by disposing the fitting-side groove wall surface 114*a* of the eccentric cam groove 114 very close to the fixed shaft 112, that is, by disposing this surface 114*a* in correspondence with the above-mentioned vertical line P, the ratio of the magnifying force by the cam lever 113 is maximized.

Figure 13:
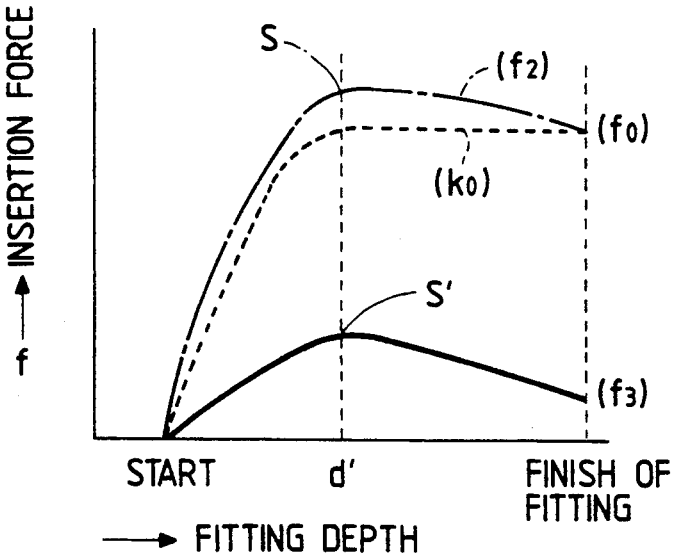
FIG. 13 is a graph showing the relation between the fitting depth of the male connector and the force acting on the lever.

FIG. 13 is a graph showing the relation between the fitting depth of the male connector A and the force acting on the cam lever 113 in the electric connector of the present invention. In this Figure, a curve of represents the case where only the female and male terminals are fitted together, and a curve f2 represents the case where the magnifying ratio of the force of the cam lever 113 is 1/1, and a curve f3 represents the case where the magnifying ratio of the force is 3/1.

When the male connector A reaches a certain depth d', the frictional resistance of the female and male terminals 103 and 6 becomes constant (ko); however, the loss of the force is decreased due to the decrease of the contact angle between the eccentric cam groove 114 of the cam lever 113 and the pin 107, and therefore the force necessary for operating the lever 113 once reaches the peak S, S', and thereafter decreases.

Therefore, after the above peak S , the fitting operation can be performed with a smaller force because of the inertia. Therefore, a proper indicative sense is obtained, and an incomplete fitting is prevented.

As described above, according to the present invention, in the female and male connector housings employing the lever mechanism, a proper indicative sense due to the inertia is obtained at the time of the fitting operation, and therefore good operability is achieved, and an incomplete fitting can be prevented.

What is claimed is:

1. A low insertion-withdrawal force electric connector comprising:

a pair of mating connectors for being fitted together;

pins formed respectively on opposite sides of one of said mating connectors;

grooves positioned so as to receive said pins being formed respectively in opposite sides of the other of said mating connectors;

can levers rotatably mounted respectively on said opposite sides of said other mating connector;

each of said cam levers having an eccentric cam groove formed therein which is engageable with a respective one of said pins so as to perform the fitting and disengagement of said two mating connectors relative to each other, along an axis, in response to angular movement of said cam lever, said cam grooves being substantially V-shaped, and having a linear side groove wall which acts upon said pins in a direction which is not coincident with said axis during an initial portion of said angular movement of said cam levers, an angle between said direction and said axis becoming smaller as said connectors advance to a fitted condition;

an operating plate interconnecting said two cam levers;

a resilient member provided on said other mating connector to bias said operating plate upward so as to hold said cam levers in an upstanding condition; and a disengagement-side groove wall of each of said eccentric cam grooves providing a wide surface for engagement with said pin when said cam levers are in their upstanding position.

2. The connector according to claim 1, in which a lock portion is provided on said operating plate so as to engage with a lock device located on said one connector.

3. The connector according to claim 2, in which said operating plate has a short-circuit piece which is contacted with short-circuit terminals of an electric circuit, serving as fitting confirmation means, in the locked condition of said operating plate to thereby short-circuit said circuit, said short-circuit terminals being contained in said other connector.

4. The connector according to claim 1 or claim 3, in which said other connector is attached to an electric device, a wall surface of said electric device serving as a support wall for supporting said operating plate.

5. A low insertion-withdrawal force electric connector comprising:

a male housing;

a female housing having a hood;

a pin mounted on one side wall of said male housing, a groove into and out of which said pin is movable being provided in said hood of said female housing; and a cam lever pivotally mounted on said hood said cam lever having an eccentric cam groove formed therein which is engageable with said pin so as to cause said two housings to be fitted and disengaged relative to each other in response to pivotal movement of said lever, a fitting-side acting surface of said eccentric cam groove, which acts upon said pin, being disposed at an angle with respect to the direction of advancement of said pin of said housings when said housings are in a partially fitted condition and being disposed generally perpendicular to said direction of advancement when said two housings are completely fitted together.

6. The connector according to claim 5, in which said fitting-side acting surface of said eccentric cam groove against said pin coincides with a vertical line extending downwardly from the axis of rotation of said cam lever toward the direction of advance of said pin.

7. A low insertion-withdrawal force electric connector comprising:

a pair of mating connectors for being fitted together;

pins formed respectively on opposite sides of one of said mating connectors;

grooves positioned so as to receive said pins being formed respectively in opposite sides of the other of said mating connectors;

cam levers rotatably mounted respectively on said opposite sides of said other mating connector;

each of said cam levers having an eccentric cam groove formed therein which is engageable with a respective one of said pins so as to perform the fitting and disengagement of said two mating connectors relative to each other, along an axis, in response to angular movement of said cam lever, said cam grooves being substantially V-shaped, and having a linear side groove wall which acts upon said pins in a direction which is not coincident with said axis during an initial portion of said angular movement of said cam levers, an angle between said direction and said axis becoming smaller as said connectors advance to a fitted condition;

an operating plate interconnecting said two cam levers;

a resilient member provided on said other mating connector to bias said operating plate upward so as to hold said cam levers in an upstanding condition;

a disengagement-side groove wall of each of said eccentric cam grooves providing a wide surface for engagement with said pin when said cam levers are in their upstanding position;

a lock portion cooperating with said operating plate, said lock portion locking said operating plate when said connectors are in said fitted condition; and a short circuit piece associated with said operating plate so as to short circuit two terminals of an electric circuit when said operating plate is locked.

8. The connector according to claim 7, wherein said other mating connector is attached to an electrical device, a wall surface of said electrical device serving as a support for said operating plate when said cam levers are in said upstanding position.

9. A low insertion-withdrawal force electric connector comprising:

a pair of mating connectors for being fitted together;

pins formed respectively on opposite sides of one of said mating connectors;

grooves positioned so as to receive said pins being formed respectively in opposite sides of the other of said mating connectors;

cam levers rotatably mounted respectively on said opposite sides of said other mating connector;

each of said cam levers having an eccentric cam groove formed therein which is engageable with a respective one of said pins so as to perform the fitting and disengagement of said two mating connectors relative to each other, along an axis, in response to angular movement of said cam lever, said cam grooves being substantially V-shaped, and having a linear side groove wall which acts upon said pins in a direction which is not coincident with said axis during an initial portion of said angular movement of said cam levers, an angle between said direction and said axis becoming smaller as said connectors advance to a fitted condition;

an operating plate interconnecting said two cam levers;

a resilient member provided on said other mating connector to bias said operating plate upward so as to hold said cam levers in an upstanding condition;

a disengagement-side groove wall of each of said eccentric cam grooves providing a wide surface for engagement with said pin when said cam levers are in their upstanding position;

said other mating connector being attached to an electrical device, a wall surface of said electric device serving as a support for said operating plate when said cam levers are in said upstanding position.

* * * * *